US007237348B2

(12) United States Patent
Motoda

(10) Patent No.: US 7,237,348 B2
(45) Date of Patent: Jul. 3, 2007

(54) SPRING PAD FOR A SHEET IRONING MACHINE

(75) Inventor: Shuho Motoda, Koshigaya (JP)

(73) Assignee: San-Ai Industries Inc., Koshigaya (JP)

( * ) Notice: Subject to any disclaimer, the term of this patent is extended or adjusted under 35 U.S.C. 154(b) by 0 days.

(21) Appl. No.: 11/464,539

(22) Filed: Aug. 15, 2006

(65) Prior Publication Data

US 2007/0062077 A1 Mar. 22, 2007

(30) Foreign Application Priority Data

Sep. 22, 2005 (JP) ..... 2005-275799

(51) Int. Cl.
*D06F 83/00* (2006.01)
*D06F 69/02* (2006.01)

(52) U.S. Cl. ..... 38/66

(58) Field of Classification Search ..... 38/44, 38/66, 45, 47, 64

See application file for complete search history.

(56) References Cited

U.S. PATENT DOCUMENTS 1,769,066 A 7/1930 McKnight
2,190,146 A * 2/1940 Bristol ..... 38/66
2,708,322 A * 5/1955 De Frances ..... 38/66
3,115,717 A * 12/1963 Schmitz ..... 38/66
5,653,049 A * 8/1997 Motoda ..... 38/66
6,836,984 B2 * 1/2005 Vanderheyden ..... 38/66

FOREIGN PATENT DOCUMENTS

| | | |
|---|---|---|
| DE | 2746708 | 4/1979 |
| EP | 0736627 | 10/1996 |
| GB | 650212 | 2/1951 |
| GB | 979585 | 1/1965 |

* cited by examiner

*Primary Examiner*—Izaguirre Ismael
(74) *Attorney, Agent, or Firm*—Martin Fleit; Paul D. Bianco; Fleit Kain Gibbons Gutman Bongini & Bianco P.L.

(57) ABSTRACT

An elongate spring pad for a sheet ironing machine includes an elongate backing strip, coil springs, and top plates. The backing strip encircles a roller of a sheet ironing machine. The coil springs are longitudinally spaced along the backing strip. Each coil spring has a connecting portion at a first end engaging the backing strip and a fixing portion at a second, opposite end that transverses the coil spring. Each of the top plates is provided on the second end of the respective coil spring. Positioning means on each top plate engage the respective coil spring. A claw projects outwardly from the top plate for releasably engaging a felt cover. Each top plate contacts an adjacent top plate so that there are no spaces therebetween.

8 Claims, 5 Drawing Sheets

FIG. 3
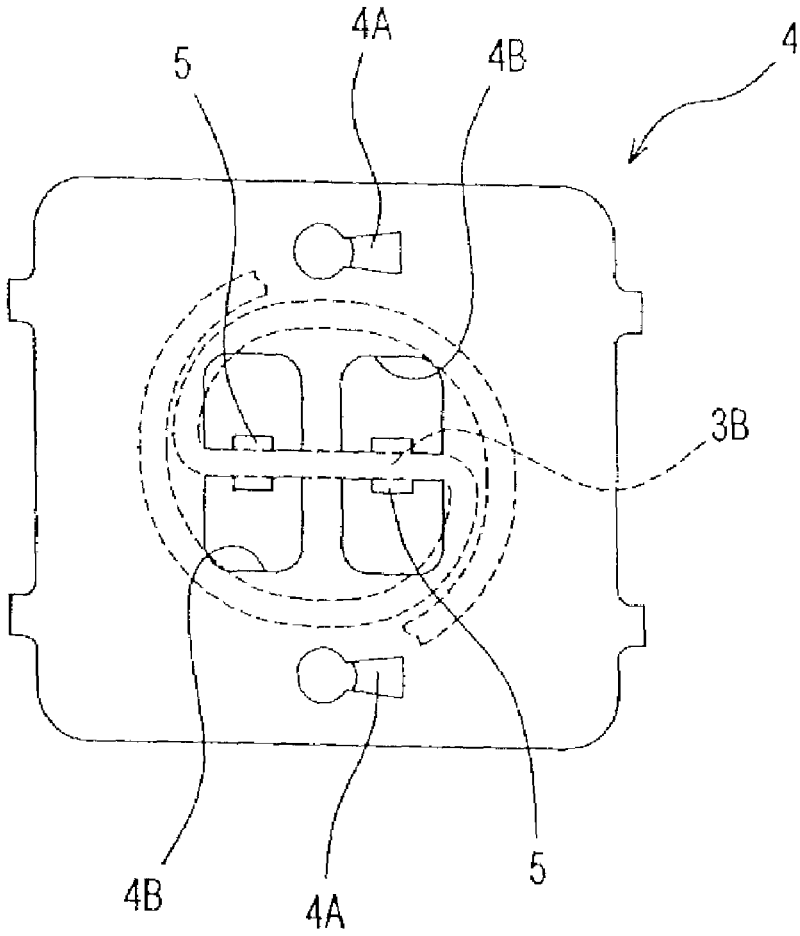
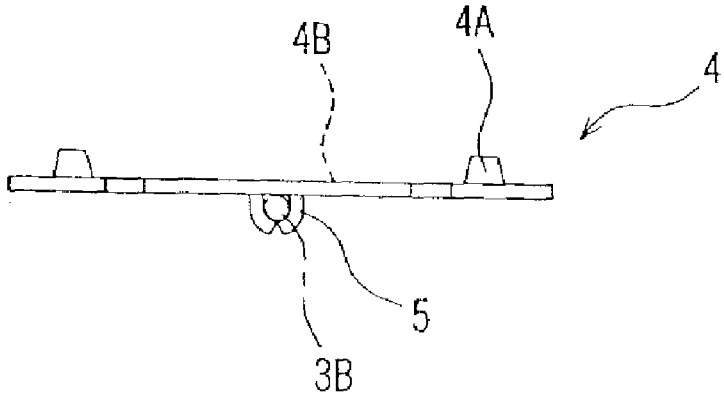
FIG. 4

SPRING PAD FOR A SHEET IRONING MACHINE

BACKGROUND OF THE INVENTION

This invention relates to a spring pad for elastically supporting a felt cover. The felt cover is rolled on the periphery of a rotatable drum of a sheet ironing machine which is used to press and finish a flat sheet of material, such as a bed sheet, table cloth and so on.

The item to be ironed, using the sheet ironing machine, is finished by putting the item between a roller or drum and a bed which is heated by steam or a thermal medium of oil. The finishing procedure results in the drying, pressing and ironing, whilst the residual water contained in the washed item becomes vapour due to the heated bed. The vapour is discharged from the side of the roller.

On the periphery of the rotatable drum is rolled a spring pad, on the outer periphery of which is positioned a felt cover.

Conventionally, there is known a spring pad as disclosed in patent application EP0736627A1 by the same applicant as the present application. The said spring pad has a plurality of coil springs arranged in predetermined spaced relationship along the longitudinal extent of the upper side of a backing strip. The backing strip contacts the periphery of the roller of the sheet ironing machine. Said coil spring has a top plate at its centre transverse portion. Said top plate is made from a press machined stainless steel band. The said top plate is made by stamping an elongate strip material to leave adjacent plates connected to one another by frangible sections which are cut by pressing works.

With the conventional spring pad for a sheet ironing machine, however, the space between adjacent top plates becomes larger when the backing strip of the spring pad is rolled on the periphery of the roller, because the top plates are mounted slightly spaced from each other on each coil spring. The space between adjacent top plates causes a scar or unsightly wrinkle on the surface of the felt cover, which contacts each top plate. This causes poor ironing finishing, such as folds, wrinkles and so on.

To avoid such marks caused by the spacing of the top plates, a thicker felt cover is needed. The felt cover employs expensive heat resistant aramid fibre, and thus the thicker felt cover increases the manufacturing cost of the sheet ironing machine, as well as decreasing the ventilation effect. The decreased ventilation decreases a drying effect (in other words, increases drying time) and impacts the finished quality of the item being ironed.

SUMMARY OF THE INVENTION

The present invention seeks to provide a solution to the inconvenience of the conventional arrangement. As such, there is provided a spring pad for a sheet ironing machine of which adjacent top plates have no space between them, and which preferably overlap each other when a backing strip of the spring pad is rolled on the periphery of the roller. This results in no traces of wrinkles or marks on the item to be ironed. Additionally, the felt cover rolled on the top plates is thin. Furthermore, the spring pad enables a reduction in cost of the sheet ironing machine, thanks to the thin felt cover to be used as well as improved finishing quality and drying effect due to the increased ventilation.

Thus, according to a first aspect of the present invention, there is provided an elongate spring pad for a sheet ironing machine, the spring pad comprising: an elongate backing strip for rolling about a periphery of a roller of a sheet ironing machine; a plurality of coil springs positioned in spaced relationship along the longitudinal extent of the backing strip, each coil spring having a connecting portion at a first end by which the respective coil spring is engaged with the backing strip, a fixing portion at a second end opposite the first end and which extends transversely across the coil spring; a plurality of independent top plates, each top plate being provided on a second end of each coil spring opposite the first end; positioning means on each top plate by which each top plate is engaged with the respective coil spring; and one or more claws projecting outwardly from the top plate for releasably engaging a felt cover, each top plate contacting an adjacent top plate so that there are no spaces therebetween.

According to a second aspect of the invention, there is provided a flat sheet ironing machine comprising a bed having a part cylindrical recess, a roller mounted for rotation in the recess, a felt cover mounted on the roller, and an elongate spring pad in accordance with the first aspect of the invention between the roller and the felt cover, the backing strip of the spring pad being tightly wound about the drum, and the claws of the top plates releasably engaging the felt cover to hold the felt cover to the top plates.

To provide a solution to the problems mentioned above, the present invention provides a spring pad for a sheet ironing machine, which comprises a backing strip 2 for contact with a periphery of a drum or roller R of a sheet ironing machine P, a plurality of coil springs 3 arranged in specific regular spaced relationship on an upper side of the backing strip. The coil springs 3 have connecting portions 3A via which the springs 3 are connected to the backing strip 2 at its lower surface, and fixing portions 3B. Each fixing portion 3B is at a top of the respective spring 3, opposite the backing strip 2, and extends centrally and transversely across the spring 3. The spring pad also comprises a plurality of top plates 4, each of which is connected via a positioning means 5 to the top of each coil spring 3. The positioning means 5 is provided on a back side of each said top plate 4 and fixes each top plate 4 to the fixing portion 3B at the top of each coil spring 3. Each top plate 4 also includes claws 4A on its upper side which, in use, softly catch the felt cover F. Each said top plate 4 overlaps an adjacent top plate 4.

Said top plates 4 are arranged so that adjacent top plates 4 overlap each other, when the backing strip 2 of the spring pad is rolled on the periphery of roller R. Preferably, the direction of overlap is in the opposite direction to the direction of rotation of roller R. In other words, when the roller R is rotating in its normal operating condition, a leading edge of each top plate is received below a trailing edge of the next adjacent top plate. This prevents or reduces the possibility that one or more top plates are deformed and also that the top cover is removed from the claws as the roller R is rotating.

Positioning means 5 are formed as a pair of inwardly extending spaced guides or arms, at or adjacent to ventilation holes 4B of top plate 4.

Said ventilation hole 4B of each top plate 4 is positioned opposite to, or to confront, ventilation hole 2B formed in backing strip 2. The back strip 2 has a plurality of the ventilation holes 2B, formed in spaced relationship along the longitudinal extent of the backing strip 2 and at positions corresponding to each coil spring 3.

The spring pad for a sheet ironing machine of the present invention, has said adjacent top pates 4 which are overlapped with each other so to provide an almost or substantially flat or smooth surface when the backing strip 2 is rolled on the periphery of roller R. Thus, no scars, marks or wrinkles are made on the surface of the thin felt F, which is rolled on the whole upper surfaces of the top plates 4.

Water vapour, originating from retained water in a washed item and provided on thin felt F, passes through said ventilation holes 4B of said top plates 4 and the ventilation holes 2B of the back strip 2, to the roller R.

The present invention provides for adjacent top plates 4 with no spaces between them, and which overlap each other when the backing strip 2 is rolled on the periphery of the roller, thus making no traces of wrinkles on the item to be ironed, even though the felt cover F, which is rolled on the top plates, is thin. Furthermore, the spring pad enables a reduction in the of the sheet ironing machine P, thanks to the thin felt cover to be used, as well as improving the finishing quality and drying effect due to the increased ventilation.

In the present invention, adjacent top plates 4 are overlapped with each other.

Due to the said adjacent top plates 4 being overlapped with each other, and this providing an almost or substantially flat or smooth surface when the backing strip 2 is rolled on the periphery of roller R, the surface of said felt cover F can be kept scar- or mark-free, even though said felt cover, which is rolled on all surfaces of the said top plate 4, is thin.

Said positioning means 5 are formed backwardly at the ventilation hole 4B of said top plate 4 to extend towards the coil spring. The positioning means are typically a pair of guides or arms provided in close spaced relationship, thus enabling easy attachment of said top plate 4 onto the coil spring 3. The positioning means 5 also improve ventilation of the felt cover F, rolled on the top or upper surfaces of said top plates 4.

Each ventilation hole 4B of said top plate 4 is located opposite to or confronted with a respective ventilation hole 2B of backing strip 2. This improves the ventilation of the felt cover F, by providing an air flow path through the ventilation holes 4B of the top plates 4 and ventilation holes 2B of backing strip 2. Thus in the finishing stage of the ironing process, the residual water in the ironed item becomes steam, which is be exhausted to the roller side through the ventilation holes 2B of backing strip 2.

The invention will now be more particularly described, by way of example only, with reference to the accompanying drawings.

BRIEF DESCRIPTION OF THE DRAWINGS

FIG. 3 is a plan view of a top plate of the spring pad;

FIG. 4 is a side view of the top plate of the spring pad;

DESCRIPTION OF THE PREFERRED EMBODIMENTS

Figure 6:
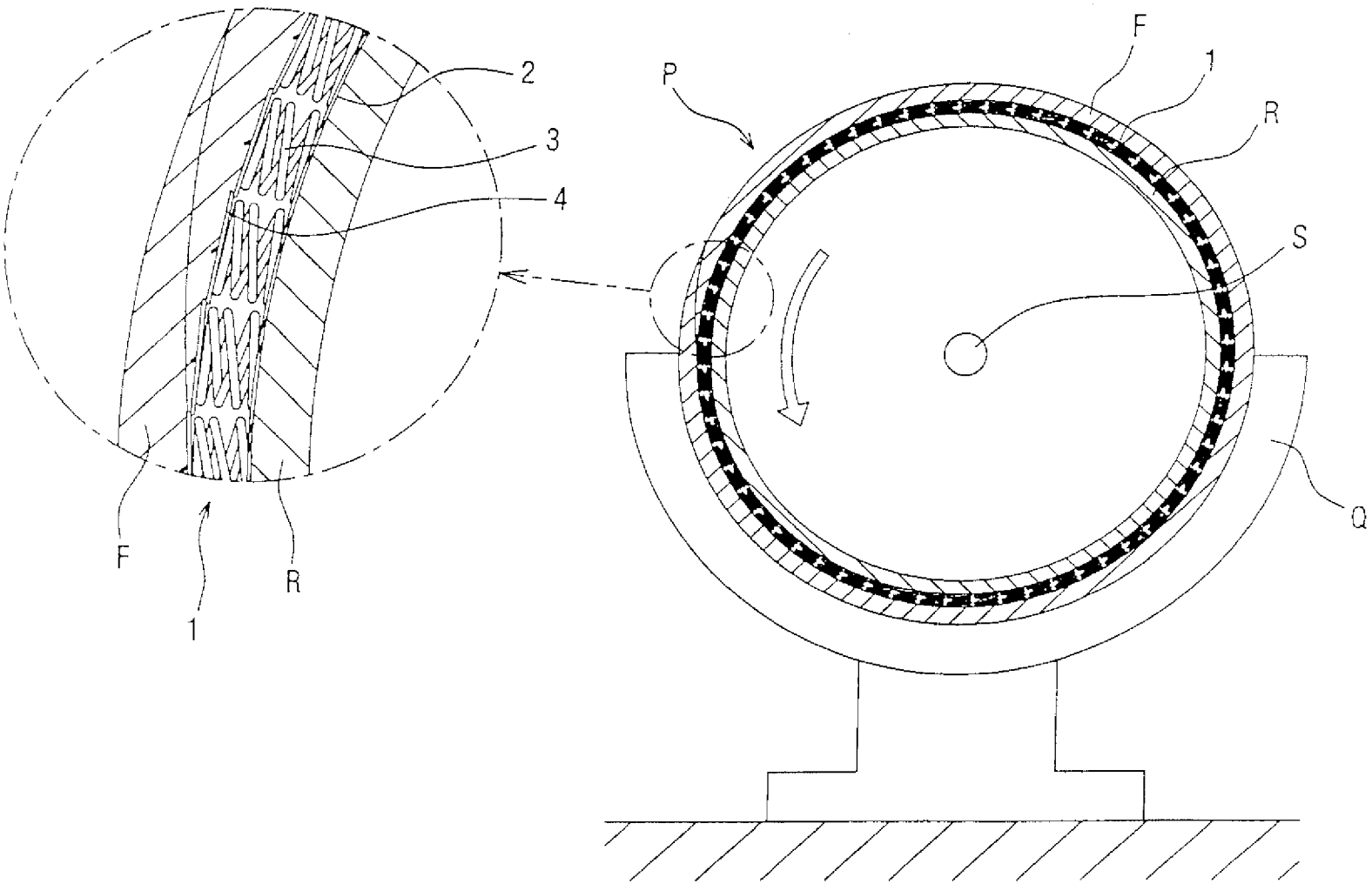
FIG. 6 is a side view with enlarged portion showing the spring pad rolled on a periphery of a roller of a sheet ironing machine.

Referring to the drawings, spring pad 1, best seen in FIG. 6, has a long belt shape and is spirally rolled from one end to another end of the roller R, along the peripheral surface thereof. Felt cover F is then rolled on the periphery of the spring pad 1, and the spring pad 1 thus elastically supports the felt cover F.

The spring pad 1 is rolled on the roller R in such a manner that a first end of the spring pad 1 is fixed at the one side or end of the roller R, and then the spring pad 1 is rolled in a tight spiral along the peripheral surface of the roller R. The spring pad 1 is under tension, and its second end opposite the first end is connected to the other side or end of the roller R via a tension spring (not shown) which has hooks at both ends.

The sheet ironing machine shown in FIG. 6 comprises the roller R which is cylindrically formed to rotate around rotational axis S and which is arranged to contact a half-cylindrical bed Q or so called "chest". Bed Q is supported by a stand, and heated by steam or a thermal medium of oil. The item to be ironed is inserted between said bed Q and said roller R and pressed, dried and finished by being pressed between said bed Q and roller R. Known urging means (not shown) urges the roller R towards the bed Q during pressing. The residual humidity or water contained in the item to be ironed becomes steam vapour, due to the heated bed Q and this vapour is exhausted through to the roller R.

A radius of the press surface of the heated bed Q coincides with or is complementarily matches a radius of roller R. The item to be ironed is taken or drawn between the press surfaces by the rotation of roller R. The item to be ironed is thus heated and pressed between heated bed Q and felt cover F. The ironed item is then discharged at the opposite side of the bed Q and roller R.

Figure 1:
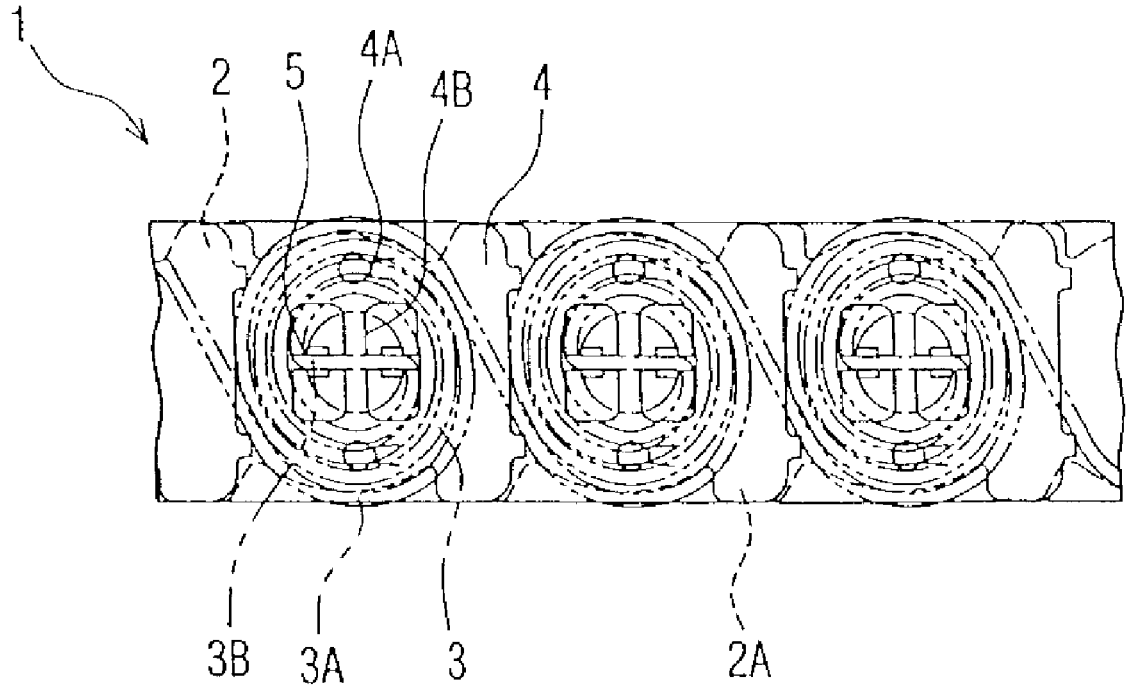
FIG. 1 is a plan view showing one embodiment of a spring pad, in accordance with the present invention.
Figure 2:
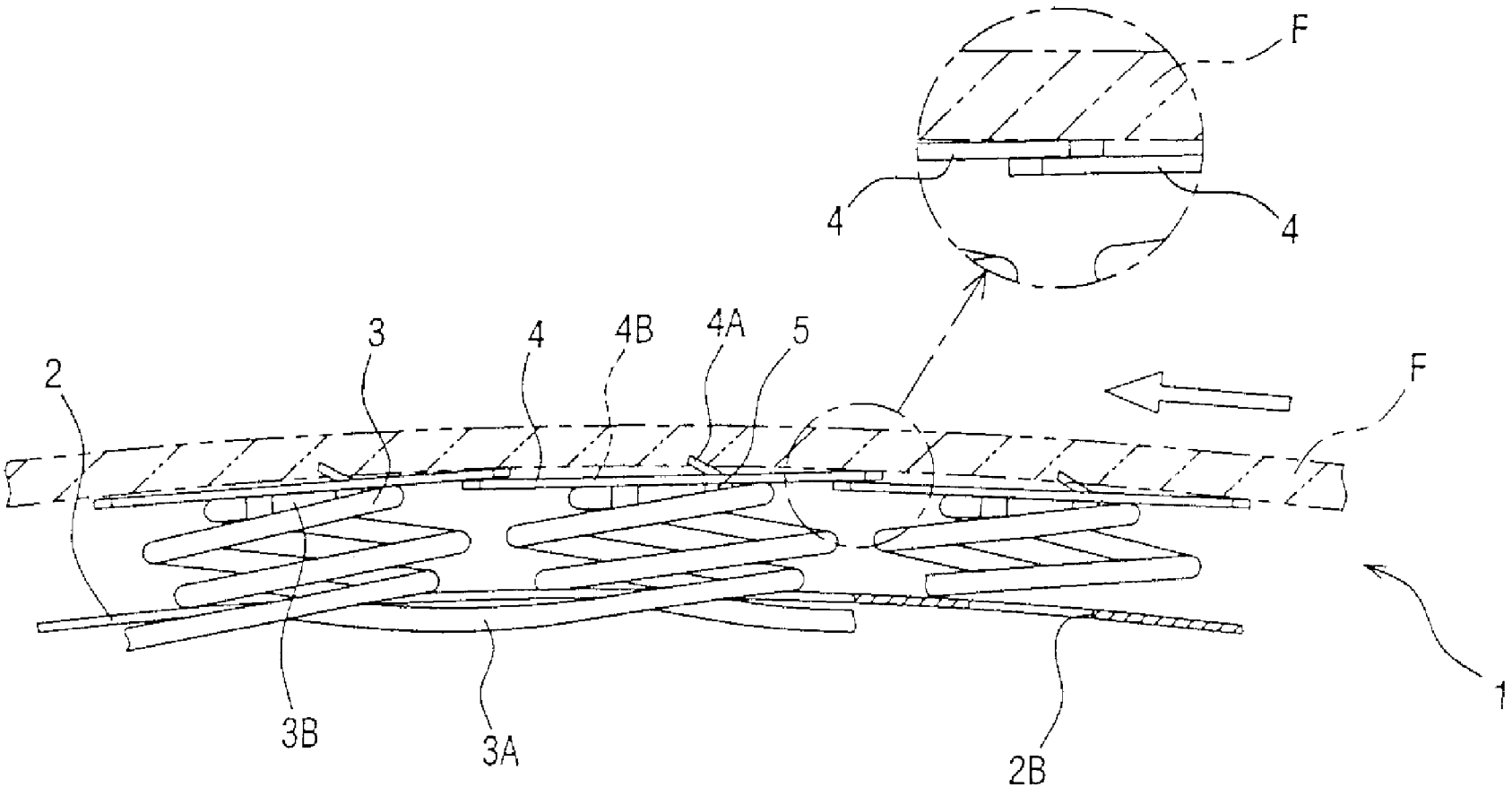
FIG. 2 is a side view of the spring pad.

The spring pad 1, as shown in FIGS. 1 and 2, comprises a long belt-like backing strip 2, typically made of stainless steel or zinc plated iron, which is rolled on the periphery of the roller R. So called 'hybrid', typically helically wound, coil springs 3 are located at specified spaced intervals on said backing strip 2, and rectangular shaped top plates 4, typically made of stainless steel for example, are fixed at the upper end of each of said coil springs 3, opposite the backing strip 2. Each coil spring 3 stands an equal specified height from said backing strip 2. A fixing portion 3B is provided at the upper end of each coil spring 3. The fixing portion 3B extends horizontally and transversely across the coil spring 3. Each coil spring 3 is integrally formed with or connected to each adjacent coil spring 3 via wire connecting part 3A, and the interconnected coil springs 3 are continuously connected to the backing strip 2 via the connecting portion 3A being wound around a back side or lower side of the backing strip 2, as best understood from FIGS. 2 and 5.

Figure 5:
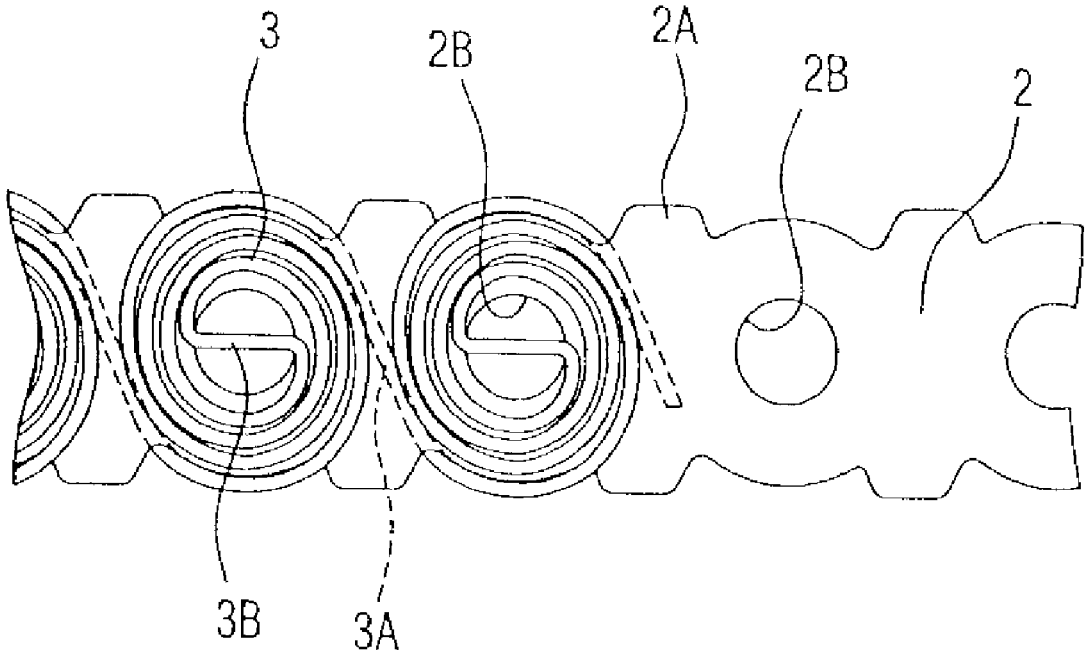
FIG. 5 is a plan view of the coil springs and backing strip of the spring pad, showing connecting portions as dotted lines.

Said backing strip 2, as shown in FIG. 5, has projected portions 2A which are formed at equal intervals along both side edges of the backing strip 2, and so as to face each other across the backing strip 2. The connecting portion 3A, which is in the form of wire between adjacent coils 3, is hooked on or wound around each said projected portion 2A. Each ventilation hole 2B is formed between two adjacent projected portions 2A of said backing strip 2.

The top plate 4 is typically formed by press-machining and bending a stainless steel plate. As shown in FIGS. 3 and 4, a pair of claws 4A, which slant upwardly in a direction opposite the coil spring 3 by more than 45 degrees are formed symmetrically on the upper surface of top plate 4, so that they can flexibly hooks the felt cover F.

The symmetrically formed U-shaped holes on said top plate 4 are typically formed by press machining. A portion of the top plate 4, which is pressed downwardly or inwardly to form the U-shaped holes, forms a pair of guides or arms of positioning means 5. A pair of left and right U shaped holes, making four holes in total opposite or confronting a respective ventilation hole 2B of the backing strip 2, are formed in said top plate 4.

The transverse fixing portion 3B of coil spring 3 is positioned between the guides or arms of positioning means 5. The fixing portion 3B is fixed to the positioning means 5 by crimping, welding or any other suitable means. The adjacent top plates 4, as shown in FIGS. 1 and 2, are dimensioned to overlap each other when the backing strip 2 is extended straight or rectilinear.

As shown in FIG. 6, when the backing strip 2 is rolled on roller R, and is thus arcuate or curved like a circle, the adjacent top plates remain overlapped, but to a lesser extent.

The adjacent top plates 4 are slightly overlapped when the backing strip 2 is rolled on the roller R, and thus produce a curved formation. In this case, the overlapped adjacent top plates 4 form a slight step, but have no space between them. Consequently, adjacent top plates 4 are always in contact with each other, irrespective of the shape of the longitudinal extent of the spring pad 1.

Preferably, the direction of overlap of the top plates 4 is in the opposite direction to the direction of rotation of roller R. In other words, when the roller R is rotating in its normal operating condition, a leading edge of each top plate is received below a trailing edge of the next adjacent top plate. This prevents or reduces the possibility that one or more top plates are deformed, and also that the top felt cover F is removed from the claws as the roller R is rotating.

An example of usage, assembly and movement of the spring pad 1 is now explained. First of all, when the spring pad 1 is manufactured, as shown in FIGS. 1, 2 and 5, the coil springs 3 are positioned with the same space between them along the longitudinal extent of the backing strip 2. The connecting portion 3A is hooked over and wound around the backing strip 2, between the projected portions 2A.

The top plates 4 are arranged and fixed at the top or upper ends of the coil springs 3, so that adjacent said top plates 4 overlap each other when the baking strip 2 is extended in a straight line. The transverse fixing portion 3B at the top of each coil spring 3 is placed between a pair of the guides, being the positioning means 5, which is then pinched or welded to fasten the top plate 4 to the coil spring 3.

To roll the spring pad 1 on the periphery of roller R of sheet ironing machine P, the starting or first end of the backing strip 2 is fixed at the one side or end of the roller R and the spring pad 1 is tightly spirally rolled under tension around the periphery of the roller R. A rolling device (not shown) is used, which engages the ventilation holes 2B of the backing strip 2 to wind the spring pad 1 onto the roller R. The opposite end of spring pad 1 is hooked on one end of a tension spring (not shown) which has hooks at both ends, and the other hooked end of the tension spring is hooked onto the side or end of the roller R to retain the spring pad 1 securely on the periphery of the roller R.

In this condition and with the backing strip 2 rolled around the periphery of roller R, as shown in FIG. 6, the tops or ends of the coil springs 3 opposite the backing strip 2 become further spaced apart. It is possible for the top plates 4 to become un-overlapped, whereby adjacent edges of adjacent top plates lie in the same plane. However, in this case, the adjacent top plates 4 still contact each other, even though there is no step therebetween, due to there being no overlap. Consequently, there is still no space between the top plates 4.

If the overlapped portions of the top plates 4 remained when the backing strip 2 is rolled on the periphery of roller R, the adjacent top plates 4 form steps, but there is no space between the top plates 4.

Thin felt cover F is rolled on the spring pad 1. The claws 4A of the upper surface of the top plate 4 catch the inside or lower surface of the felt cover F. The entire lower surface of the felt cover F thus contacts the whole upper surface of the top plates 4. Thus, no marks are made on the surface of felt cover F, because the felt cover F is elastically supported by the spring pad 1 and because there is no space between the adjacent top plates 4.

When the sheet ironing machine P is used, the heated surface of bed Q is heated by the heat source and the roller R is rotated to stick or draw the item to be ironed between the pressing surfaces of the bed Q and the roller R. The item is thus pressed on to the heated bed Q, before being discharged at the opposite side of the roller R.

The humidity or residual water retained in the item to be ironed becomes steam, due to the heated bed Q, and the resulting vapour is thus discharged from the centre of the roller R via the flow path formed by the ventilation holes 4B in the top plates 4, the interiors of the coil springs 3, and the ventilation holes 2B in the backing strip 2.

Thus the item to be ironed has no trace of wrinkles or marks, due to the felt cover remaining entirely smooth.

The embodiments described above are given by way of examples only, and various other modifications will be apparent to persons skilled in the art without departing from the scope of the invention, as defined by the appended claims.

Explanation of the Marks

P: Sheet ironing machine
Q: Bed
R: Roll
F: Felt cover
S: Rotating axis
1: Spring pad
2: Backing strip
2A: Projected portion
2B: Ventilation hole
3: Coil spring
3A: Connecting portion
3B: Transverse fixing portion
4: Top plate
4A: Claw
4B: Ventilation hole
5: Positioning measures

What is claimed is:

1. An elongate spring pad for a sheet ironing machine, the spring pad comprising:

an elongate backing strip for rolling about a periphery of a roller of a sheet ironing machine;

a plurality of coil springs positioned in spaced relationship along the longitudinal extent of the backing strip, each coil spring having a connecting portion at a first end by which the respective coil spring is engaged with the backing strip, a fixing portion at a second end opposite the first end and which extends transversely across the coil spring;

a plurality of independent top plates, each top plate being provided on a second end of each coil spring opposite the first end;

positioning means on each top plate by which each top plate is engaged with the respective coil spring; and one or more claws projecting outwardly from the top plate for releasably engaging a felt cover, each top plate freely and slidably contacting an adjacent top plate so that there are no spaces therebetween when the spring pad is in a rectilinear condition and an arcuate condition.

2. An elongate spring pad as claimed in claim 1, wherein each top plate overlaps an adjacent top plate.

3. An elongate spring pad as claimed in claim 1, wherein each top plate overlaps an adjacent top plate when the spring pad is in the rectilinear condition.

4. An elongate spring pad as claimed in claim 1, wherein each top plate overlaps an adjacent top plate when the spring pad is in the arcuate condition.

5. An elongate spring pad as claimed in 2, wherein a direction of the overlap of the top plates is opposite a normal operational direction of rotation of the roller.

6. An elongate spring pad as claimed in claim 1, wherein the backing strip includes a plurality of ventilation holes, and each top plate includes a ventilation hole, each top plate ventilation hole being aligned with a corresponding backing strip ventilation hole.

7. A flat sheet ironing machine, comprising:

a bed having a part cylindrical recess, a roller mounted for rotation in the recess, a felt cover mounted on the roller, and an elongate spring pad between the roller and the felt cover, the spring pad including:

an elongate backing strip being rollable about a periphery of the roller to be tightly wound about the drum, a plurality of coil springs spaced longitudinally along the backing strip, each of the coil springs having a connecting portion at a first end engaging the backing strip and a fixing portion at a second end opposite the first transversing the coil spring, a plurality of independent top plates, each of the top plates being provided on a second end of a respective one of the coil springs, having positioning means engaging the respective one of the coil spring, and having at least one claw projecting outwardly from the top plate for releasably engaging the felt cover to the respective one of the top plates, and each of the top plates freely and slidably contacting adjacent ones of the top plates so that there are no spaces therebetween when the spring pad is in a rectilinear condition and an arcuate condition.

8. A flat sheet ironing machine as claimed in claim 7, further comprising means for urging the roller towards the bed.

* * * * *